United States Patent [19]

Durenec

[11] 4,092,829

[45] June 6, 1978

[54] BALANCED COMPRESSOR

[75] Inventor: Peter Durenec, Annandale, Va.

[73] Assignee: The United States of America as represented by the Secretary of the Army, Washington, D.C.

[21] Appl. No.: 629,452

[22] Filed: Nov. 6, 1975

[51] Int. Cl.[2] ..... F01B 29/10; F02G 1/04

[52] U.S. Cl. ..... 60/517; 62/6; 92/69 R; 92/117 A

[58] Field of Search ..... 92/72, 69, 117; 417/486, 488, 469; 60/517; 62/6

[56] References Cited

U.S. PATENT DOCUMENTS

| | | | |
|---|---|---|---|
| 196,070 | 10/1877 | Brotherhood | 92/72 |
| 1,126,109 | 1/1915 | Smith | 417/469 |
| 1,372,764 | 3/1921 | Miller | 417/469 |
| 1,999,211 | 4/1935 | Savzedde | 92/72 |
| 2,004,161 | 6/1935 | Fausel | 417/469 |
| 2,055,324 | 9/1936 | Walter, Jr. | 92/72 |
| 2,063,367 | 12/1936 | De La Roza, Sr. | 417/469 |
| 2,898,166 | 8/1959 | Kohler | 62/6 |
| 2,943,453 | 7/1960 | Jonkers | 60/517 |
| 3,130,592 | 4/1964 | Burrison | 92/72 |
| 3,190,233 | 6/1965 | Welch | 92/72 |
| 3,604,402 | 9/1971 | Hatz | 92/72 |
| 3,673,809 | 7/1972 | Bamberg | 62/6 |
| 3,839,946 | 10/1974 | Paget | 92/170 |

FOREIGN PATENT DOCUMENTS

| | | | |
|---|---|---|---|
| 583,223 | 6/1924 | France | 92/117 |
| 112,767 | 10/1918 | United Kingdom | 92/72 |

*Primary Examiner*—Martin P. Schwadron
*Assistant Examiner*—Abraham Hershkovitz
*Attorney, Agent, or Firm*—Nathan Edelberg; John E. Holford; Robert P. Gibson

[57] ABSTRACT

A compressor for a cryogenic cooler such as the Stirling cycle type or equivalent related types is provided in which all the forces and moments generated by its moving parts are balanced to eliminate noise and vibration.

7 Claims, 5 Drawing Figures

BALANCED COMPRESSOR

The invention described herein may be manufactured, used, and licensed by or for the Government for governmental purposes without the payment of any royalty thereon.

BACKGROUND OF INVENTION

The requirements of electronic detection and surveillance systems using low temperature solid state devices has led to a new class of cooling systems. They differ from previous systems primarily in the small amount of heat transported to obtain a considerable temperature differential, e.g. ambient to liquid nitrogen temperatures. In early devices the cooling was, in fact, achieved by adding liquid nitrogen through a system of dewars, the liquid being produced by a remote processing plant. The logistics involved in supporting such a system, at least in military situations, soon becomes prohibitive.

Since thermoelectric coolers do not provide the necessary temperatures and efficiencies, the latest systems generally employ cryogenic coolers like the Stirling cycle devices, i.e. closed systems with compressors and regenerators. The most practical compressor currently available appears to be the type using a cylinder enclosing a moving piston; the latter being driven by a crankshaft, through connecting rods, in a conventional manner well known in the art. These devices perform efficiently, and when driven by an electric motor sealed into the system, have extremely long lifetimes.

One drawback of these systems is that they produce considerable noise and vibration. This is particularly true of single cylinder compressors which are most desired for portable electro-optical systems, because of their small size and weight. Two cylinder arrangements can be balanced, but even these can become unbalanced as the components of one cylinder wears more than the other. The noise problem is important in military and similar roles where the devices are often used in covert operations.

SUMMARY OF INVENTION

An object of the present invention is therefore to provide a single cycle compressor for use in a Stirling cycle cooler or equivalent closed system which is essentially free of vibration and noise.

A further object is to provide the above compressor with completely balanced forces and moments including those forces exerted by the working gas in the system.

BRIEF DESCRIPTION OF DRAWINGS

The invention will be best understood with reference to the accompanying drawings wherein.

DESCRIPTION OF INVENTION

Figure 1:
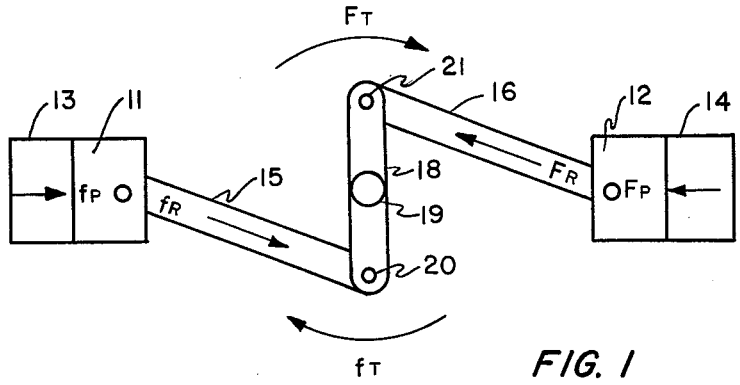
FIG. 1 shows a free body diagram of the moving parts of a prior art compressor having two opposed cylinders.

Referring specifically to FIG. 1 there is shown a conventional two cylinder compressor having balanced opposed pistons 11 and 12. If it is first assumed that each cylinder 13 and 14 and its piston develops the same compressive forces and the rods 15 and 16 with crank arms 17 and 18 linking them to the crankshaft 19 are identical; then the applied torque forces ($F_r$ and $f_r$) at the rod bearings (20 and 21) are balanced by the forces exerted on the pistons ($F_p$ and $f_p$) and subsequently the rods ($F_r$ and $f_r$) by the compressed gas and the acceleration of these parts. The result is a low vibration, efficient and quiet compressor. Unfortunately the two cylinder design occupies a much greater volume than a one cylinder device having the same cooling capacity. There is also the problem of handling two gas flows with duplicate couplings and other associated hardware.

Figure 2:
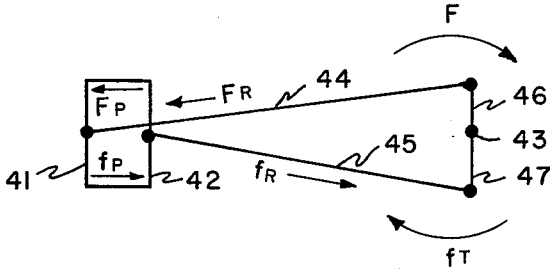
FIG. 2 shows a free body diagram of a system of the type involved in the present invention, and the forces acting thereon.

FIG. 2 shows conceptually the one cylinder approach employed in the present invention. Both pistons 41 and 42 are placed on the same side of the crankshaft 43 with one of the pistons, such as 41, performing its compression on the downstroke (toward the crankshaft). Each of the above changes provides a cancelling reversal of the directional forces $F_p$ and $F_r$ exerted through rods 44 and 45 on crankarms 46 and 47, so that the forces remain balanced. Again complete symmetry, except for the changes noted above, has been assumed between the two compressor systems. The compression chambers of the two systems may now be contiguous, or as the diagram implies they can have one cylinder in common. If assymetry is permitted additional extremely useful compressor designs result.

Figure 3:
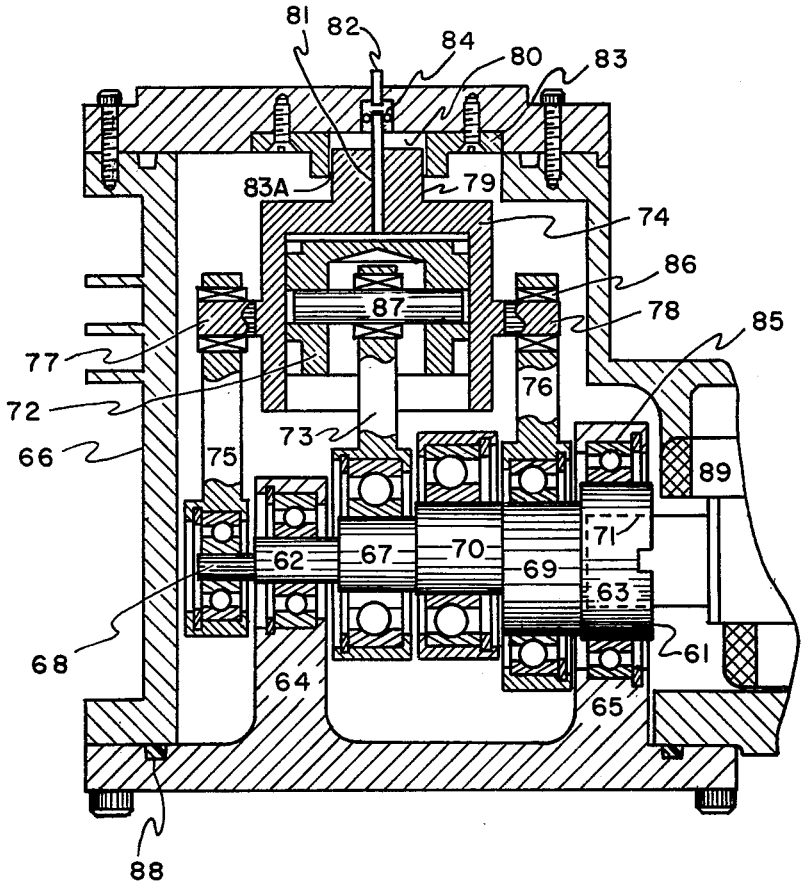
FIG. 3 shows a cutaway view of a one cylinder compressor using the principles set forth in FIG. 2.

FIG. 3 shows an embodiment using assymetrical elements based on the principles discussed at FIG. 2. In order to make a quiet cooler a high speed crankshaft 61 is used which employs a small stroke, e.g. one eighth of an inch. The crankshaft thus takes the form of an integral series of sections comprising solid cylinders 62, 63, and 67 – 70, two of which have parallel axes (62 and 63) that lie on the axis of rotation and are journalled in support members 64 and 65. The latter are part of a housing 66 which encloses the entire compressor. A central solid cylinder 67 is radially displaced an amount equal to at least half of the stroke of the compressor. Two additional solid cylinders 68 and 69 are located adjacent to cylinders 62 and 63. These are radially offset diametrically opposite to the displacement of cylinder 67 an amount equal to the difference between the compressor stroke and the displacement of 67. In operation the crankshaft is rotated by an electric motor 89 also sealed within housing 66.

A piston 72 is connected to section 67 of the crankshaft by a connecting rod 73 in the usual manner. A hollow compressor cylinder 74 surrounds the piston and is also connected to the crankshaft by piston rods 76 and 76 which engage pintle 77 and 78 on the cylinder and sections 68 and 69 of the crankshaft.

The upper end portion 79 of the cylinder is reduced in diameter and fits snugly into a guide recess 80, which may be lined with a dry lubricant such as that provided by a filled Teflon or Rulon end piece 83. This restricts the movement of the compression cylinder to axial motion only. The upper end portion also has a short piece of conduit 81 sealed through it which overlaps a similar axially aligned conduit 82 at least the end portion of which is of a different diameter and is sealed through the adjacent housing wall. The opposing wall of one conduit may be grooved to receive slideable O-ring seals 84 or the conduits may just fit snugly but slideably within one another. Since the end piece 83 is a guide and cannot be a seal there is sufficient clearance passageway 83A, which has been exaggerated in the drawing, between it and the end portion 79 of the cylinder to permit working gas that leaks out of the junction between the conduits to return to the housing and which conventionally is charged with the working gas at ambient pressure and thus forms a part of most cryogenic cooling systems.

As is well known, these devices may be fabricated from aluminum alloys, steel or any other suitable metal. For convenience of servicing the housing is best made in sections with seals of resilient material, e.g. rubber 88 between mating surfaces. Filled Teflon, powdered metal, or bronze bearings 86 can be used except on the crankshaft where roller bearings like bearing 85, are preferred. The housing is preferably finned to facilitate heat loss. If the cylinder and piston and their connecting rods have equal masses and strokes, a well balanced vibration free assembly is obtained. By using a high speed crankshaft each may travel only one sixteenth of an inch. There is a tendency for the cylinder 74 to be heavier than the piston and this can be compensated by reducing its share of the stroke so that its average mass-acceleration product equals that of the piston. An additional section 70 may be added to the crankshaft for Stirling cycle and related types of coolers. This section can be used to drive the regenerator which is mounted in quadrature relationship behind the crankshaft in conventional fashion. Since this unit represents a light load, which is easily countered balanced, its contribution to the vibration problem can be neglected.

The working gas in this system is preferably helium, which imposes critical limitations on seals between external parts of the housing. The manner of forming these seals, however, is well known in the art. The system is prepressurized above 300 psi, the light gas easily bypassing the snug fitting piston to maintain at least ambient pressure in the compression chamber. Leakage around the piston is sufficiently retarded, however, to permit peak pressures close to 600 psi, due to the extremely high piston velocity of which this compressor is capable. In operation the electric motor 89 turns the crankshaft about the axis of cylindrical sections 62 and 63 which are constrained by the wall sections 64 and 65. The remaining sections 68, 67, 70, and 69 move in camlike motions due to the displacement from the axis of sections 62 and 63. In particular the pair of sections 68 and 69 because of their similar displacement move together, while singular section 67 has a similar motion which is 180° out of phase with sections 68 and 69. Thus, the cylinder 74 which is connected to the pair always moves in the opposite direction to the piston 72. This produces sinusoidal pressure pulses in the compression chamber defined between the piston and cylinder which are transmitted through conduits 81 and 82. The small relative motion between the conduits is permitted by the O-ring seal 84 without significant attenuation of the pressure wave. The pressure waves are piped to a regenerator of a cryogenic cooler, not shown, the operation of which is well understood in the art.

Figure 4:
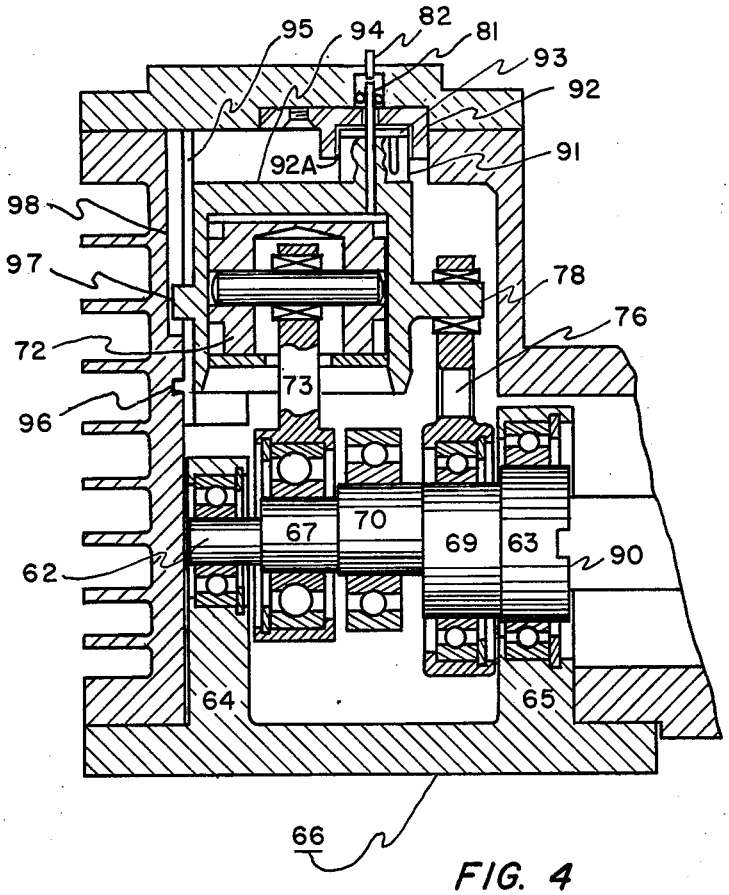
FIG. 4 shows a second embodiment of a compressor with a simplified bearing arrangement.

FIG. 4 shows a modification of the FIG. 3 device which provides a considerable reduction in size. Like numerals indicate identical elements. A new crankshaft 90 is used which has identical sections except that section 68 is omitted. The rod 75 and pintle 77 are also omitted. The reduced end 91 of the cylinder is displaced to the driven side of the compression cylinder 74 to reduce the moment exerted thereon, which might otherwise interfere with the sliding movement within the guide recess 93 provided by end piece 92. The latter is a modification of the element 83 in FIG. 3. A guide 95 of the same material is inserted between cylinder 74 and the adjacent wall of housing 66 to form a sliding channel guide for the cylinder diametrically opposite pintle 78. Dentents 96 on the channel extend into the wall of the housing to position this member. The latter is longer than the hollow cylinder by at least the stroke thereof and extends approximately 60° around it. To prevent rotation of the piston, it may have a side pin 97 opposite pintle 78 keyed through the channel guide into an axial slot 98 formed in the cylinder wall. The same arrangement of conduits 81 and 82 is employed but is, of course, displaced like the reduced end portion 91 through which one extends. An exaggerated leakage path 92A equivalent to 83A in FIG. 3 also exists in this structure. The performance of this embodiment closely approaches that of the FIG. 3 device with a considerable reduction in size, weight and cost.

Figure 5:
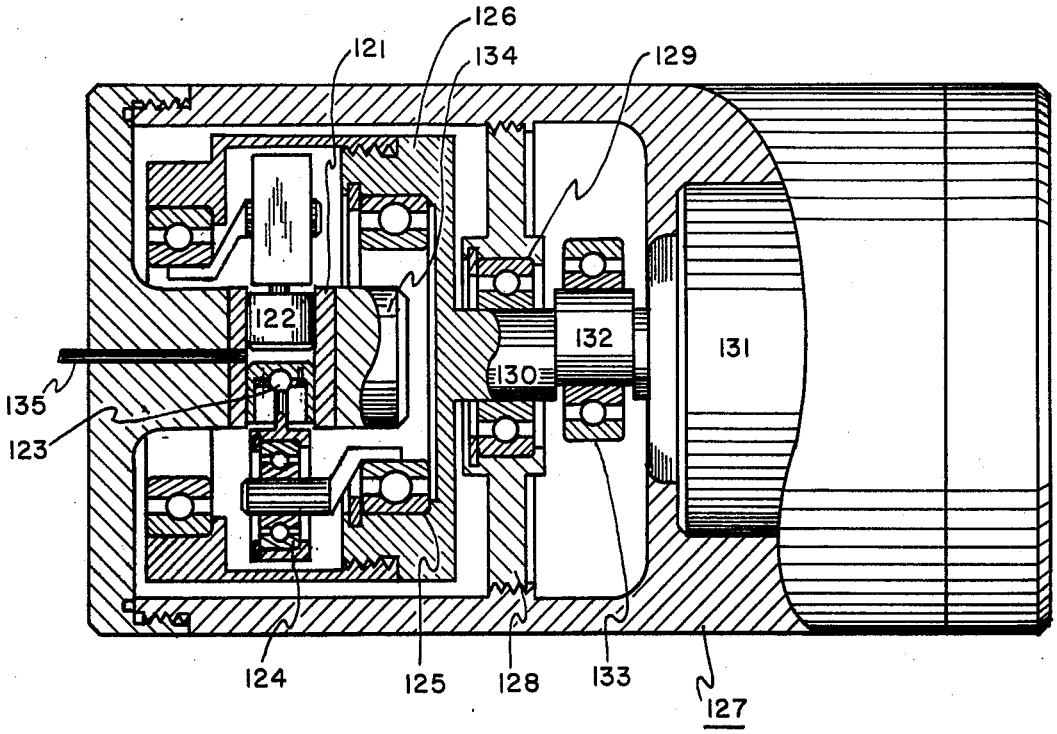
FIG. 5 shows a third embodiment utilizing opposed pistons.

FIG. 5 shows a considerably different embodiment of the invention. Instead of forming the walls of the compression chamber from a moving closed cylinder and a moving piston, this embodiment uses a fixed hollow cylinder 121 with two open ends and a separate piston 122 slideably mounted in each open end. Each piston has a connecting rod with a first end attached by a ball and socket joint 123 near its center of mass. The second end of the rod is rigidly attached to the outer race of a rod ball bearing 124. The inner race of the same bearing is rigidly attached to the inner race of a much larger circular ball bearing 125 by an axle normal to the center plane through the center of the balls therein. The larger crank bearings are arranged so that their center planes are parallel to the axis of the compression cylinder 121. The axis of rotation of each crank bearing intersects the axis of cylinder 121 at points equally and oppositely spaced from the center of the cylinder. The outer races of the crank bearings are rigidly interconnected by a cup shaped flywheel 126 which in turn is rigidly mounted on a shaft for rotation about the axis normal to the center planes of the bearings which passes through the center of cylinder 121.

A housing 127 surrounds the above structure and includes a support 128 and bearing 129 for the shaft 130 of the flywheel. As with the FIG. 3 device, the shaft is coupled to an electric motor 131 within the housing with conventional electrical terminals (not shown) sealed through the housing wall. Again the shaft may be provided with an eccentric section 132 and bearing 133 to drive a regenerator behind section 132 when the compressor is to be operated as a Stirling cycle or related types of cooler.

The housing also provides a support for the compression cylinder in the form of an axial stub extending from the nearest end wall thereof. The stub is large enough that it can be drilled to accept the cylinder. The cylinder may extend beyond the stub, if desired, and fixed in position with pins or screws (not shown). The stub and cylinder are drilled and fitted with a leakproof tubing 135 to pass the compressed gas to a cooling unit or regenerator. Fins (not shown) may be provided on the exterior of the housing to dissipate heat generated in the stub 134. As the flywheel is turned, the eccentric positions assigned to the axes of the crank bearings causes the pistons to move in opposite directions. Since the radially moving masses are kept near the axis of rotation, vibration is likewise kept to a minimum.

Many variations of the above described structures will be obvious to those skilled in the art, but the invention is to be limited only as described in the claims which follow.

I claim:

1. In a closed cryogenic cooling system comprising an electric motor driving a compressor which feeds a regenerator through a conduit, the system containing a low molecular weight gas at a minimum pressure orders of magnitude greater than atmospheric pressure; the improvement wherein said compressor comprises:

a crankshaft having at least first and second cylindrical sections with axes parallel to but displaced a short distance in opposite directions from the axis of rotation in said crankshaft;

a piston and a first rod connected between said piston and said first cylindrical section to provide a displacement thereof equal to twice said short distance associated with said first section;

a hollow cylinder closed at one end snugly and coaxially fitted around said piston to provide a compression chamber therebetween, and at least a second rod connected to said cylinder and said second cylindrical section to produce a displacement of said cylinder which is opposite to that of said piston the weights and displacements of said piston and cylinder being balanced to produce minimum crankshaft vibration;

a housing surrounding said motor crankshaft, piston and cylinder, the walls of said housing being charged with said gas at said minimum pressure and having inward projections providing bearing supports for said crankshaft and a first guide recess to slideably engage the outer surface of said cylinder, thereby restricting it to axial translation only; and said conduit being sealed through the wall of said housing into said recess and having a telescoping section within said housing communicating with said compression chamber, whereby said gas at high ambient pressure within said housing leaks into said chamber and is forced into said conduit at even higher pressure by the relative motion of said piston and cylinder and any gas leaking through said telescoping section into said recess passes freely back into said housing.

2. The system according to claim 1 wherein:

said piston and cylinder have unequal masses and the axes of said first and second sections are displaced unequal distances from said axis of rotation, said distances being inversely proportional to said masses.

3. The system according to claim 1 wherein:

said guide recess is defined by a wall portion of said housing consisting of filled Teflon.

4. The system according to claim 1 wherein:

said crankshaft includes a third cylindrical section, said second and third sections having equal displacements and both being connected to said cylinder on opposite sides thereof.

5. The compressor according to claim 1 wherein:

said cylinder is connected to said second cylindrical section at a point displaced from the axis of said cylinder on one side thereof, said first guide recess is located on said one side; and a portion of the housing wall opposite said one side includes a piece of filled Teflon to form a channel guide for said cylinder.

6. The compressor according to claim 5 wherein:

said portion of housing wall and channel guide define an axial slot; and said cylinder includes a pin projecting into said slot to prevent rotation of said clyinder.

7. The system according to claim 1 wherein: said gas is helium at a pressure of 300 psi.

* * * * *